US005409310A

United States Patent [19]

Owczarz

[11] Patent Number: 5,409,310

[45] Date of Patent: Apr. 25, 1995

[54] SEMICONDUCTOR PROCESSOR LIQUID SPRAY SYSTEM WITH ADDITIVE BLENDING

[75] Inventor: Aleksander Owczarz, Kalispell, Mont.

[73] Assignee: Semitool, Inc., Kalispell, Mont.

[21] Appl. No.: 129,700

[22] Filed: Sep. 30, 1993

[51] Int. Cl.[6] ..... B01F 15/04

[52] U.S. Cl. ..... 366/136; 134/95.2; 134/95.3; 134/102.1; 239/127; 239/434; 366/160.5; 366/153.1; 366/163.2

[58] Field of Search ..... 366/136, 142, 150, 151, 366/152, 153, 159, 160, 162, 163; 137/888; 239/127, 434; 134/95.2, 95.3, 102.1

[56] References Cited

U.S. PATENT DOCUMENTS

| | | | |
|---|---|---|---|
| 3,023,764 | 3/1962 | Dooley et al. . | |
| 3,474,965 | 10/1969 | Coleman | 239/127 |
| 4,073,664 | 2/1978 | Zwirlein . | |
| 4,335,737 | 6/1982 | Power . | |
| 4,482,704 | 11/1984 | Luetzelschwab | 366/136 |
| 4,580,699 | 4/1986 | Black et al. . | |
| 4,722,363 | 2/1988 | Allyn | 137/888 |
| 4,738,541 | 4/1988 | Weber | 366/163 |
| 4,823,987 | 4/1989 | Switall | 366/153 |
| 4,917,123 | 4/1990 | McConnell | 134/95.2 |
| 5,085,560 | 2/1992 | Thompson et al. . | |

FOREIGN PATENT DOCUMENTS

| | | |
|---|---|---|
| 286883 | 9/1987 | European Pat. Off. . |
| 858413 | 11/1940 | France . |
| 1169298 | 12/1958 | France . |
| 3906577 | 6/1990 | Germany . |
| 11-11827 | 5/1986 | Japan . |

*Primary Examiner*—Robert W. Jenkins
*Attorney, Agent, or Firm*—Wells, St. John, Roberts, Gregory & Matkin

[57] ABSTRACT

A semiconductor processor blending system for diluting a concentrated liquid additive into an actively flowing primary liquid. The concentrated additive is stored in a reservoir and transferred to a drained mixing tank via a metering pump. A diluent supply adds a measured amount of diluent to the mixing tank to provide a diluted additive. Primary fluid flows through aspirator-injectors having a suction port which draws from the mixing tank. This provides two-stage dilution which can easily achieve very dilute ratios of the additive.

31 Claims, 2 Drawing Sheets

SEMICONDUCTOR PROCESSOR LIQUID SPRAY SYSTEM WITH ADDITIVE BLENDING

TECHNICAL FIELD

The field of this invention is semiconductor processing equipment spray liquid additive blending systems, particularly those for blending very concentrated additives into a highly purified spray liquid to achieve a very dilute resultant concentration of the additive.

BACKGROUND OF THE INVENTION

In the processing of semiconductors it is not uncommon to use liquid sprays or other liquid delivery systems. This is often done in the context of centrifugal machines which rotate one or more wafers or other semiconductor pieces being processed while a liquid spray is directed against one or more surfaces of the pieces.

Many of these liquid delivery systems have need to provide a liquid which is a combination of two or more additive liquid constituents. It is sometimes the case that one or more of the constituents is in very dilute concentration relative to water or another primary liquid. Producing such very dilute concentrations of liquid additives is now done by batch dilution in other mixing equipment. This requires additional handling to mix the liquids and additional time in repeatedly loading the diluted mixtures into the processing machinery.

Thus there is a continuing and substantial need for liquid handling systems which can blend a concentrated liquid additive into an actively flowing liquid stream in very dilute proportions. Such systems need also provide consistent concentrations and extremely high purity levels of the blended liquids.

BRIEF DESCRIPTION OF THE DRAWINGS

One or more preferred forms of the invention are described herein with reference to the accompanying drawings. The drawings are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
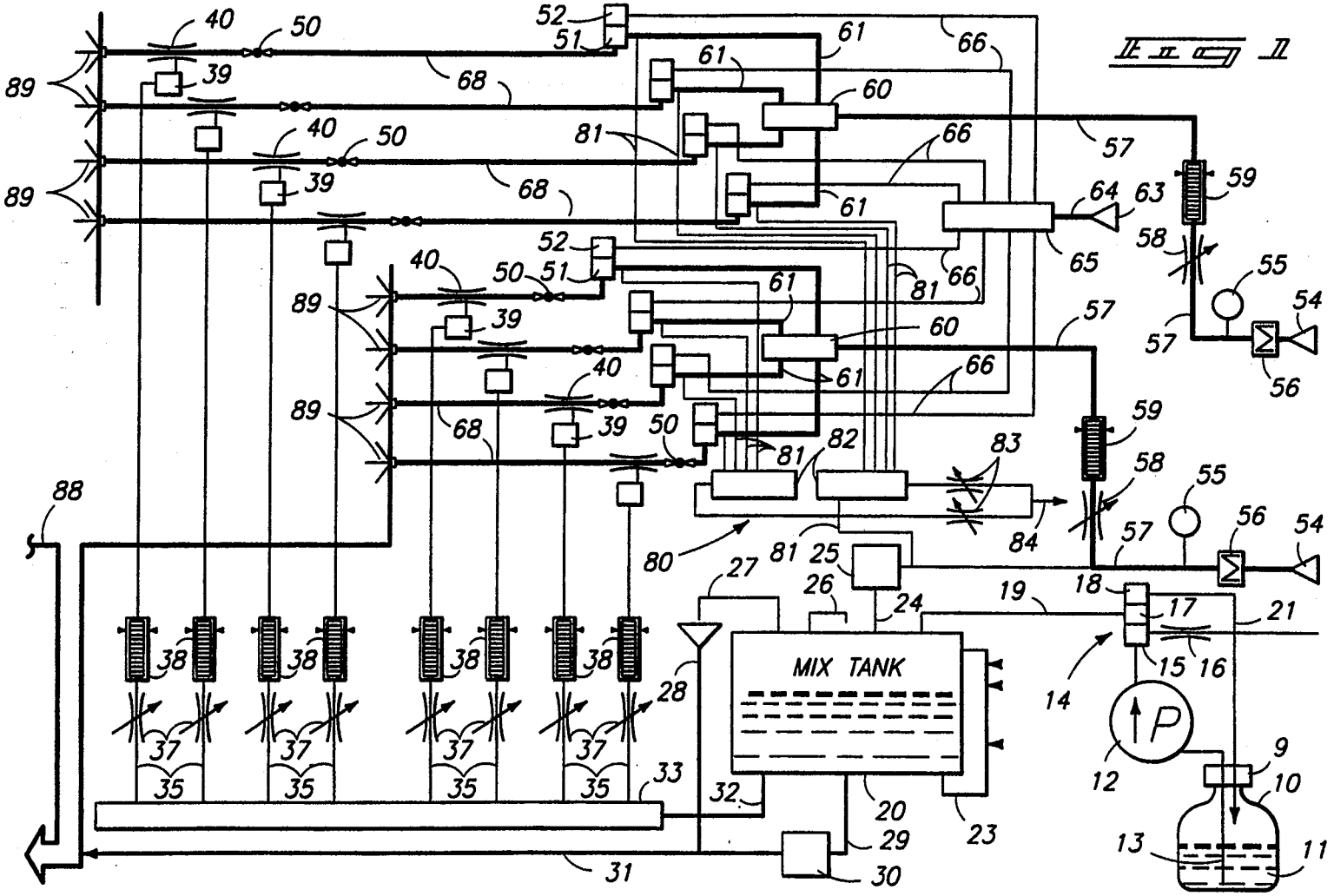
FIG. 1 is a fluid schematic diagram showing a preferred semiconductor processor liquid spray additive blending system according to this invention.

FIG. 1 shows a preferred semiconductor processor liquid blending system in accordance with this invention. The system includes a concentrate reservoir 10. Reservoir 10 advantageously is provided by a stock or supply container having a suitable concentrated liquid additive which is to be injected into a primary liquid. An example of a preferred system is use of a surfactant 11 stored within reservoir 10 which is injected into deionized water serving as the primary liquid. The surfactant must be injected in concentrations which remain uniform with time, but which are very dilute, for example 1:10,000. Reservoir 10 is preferably provided with a detachable top closure assembly 9 which supports a suction line 13 and a recycle line 21. This allows the surfactant container to be changed and fitted with the top closure. Suction line 13 is connected to a pump 12. Pump 12 is preferably a metering pump such as that shown in U.S. Pat. No. 5,085,560 which is hereby incorporated in its entirety by reference. Other suitable pumps may also be used.

Pump 12 is preferably constructed so as to provide a means for determining the amount of additive delivered from reservoir 10 to a mix tank 20. The outflow from pump 12 is connected to a series of valves 15, 17, and 18 which are ganged together. Valve 15 controls application of a gas purge to the pump and related valves. The purge has an orifice 16 which controls the rate of gas flow into the valve and pump assembly. Purge 15 is supplied with nitrogen, clean dry air, or other suitable purge gas.

Valve 17 is a mix tank delivery control valve. This valve is most preferably an electrically controlled, pneumatically operated valve. The output of valve 17 is connected to a mix tank concentrate delivery or feed line 19. Recycle valve 18 is connected to valve 17 and provides recycle flow back to reservoir 10 via concentrate recycle line 21 when valve 17 is in a closed condition.

The system of FIG. 1 also includes a mix tank 20. Mix tank 20 is fed with additive concentrate via line 19, and a diluent via diluent feed line 24. A preferred diluent for the system being described is deionized or distilled water supplied from a purified water source 54. Water delivery to mix tank 20 is controlled via a diluent feed control valve 25. Valve 25 is also an electrically controlled, pneumatically operated valve. Other valves generally shown as square boxes in FIG. 1 are also of this type.

Mix tank 20 further includes means for determining the contents of the tank. This can advantageously be provided by a level or volume measurement gauge 23 having electronic output. Mix tank gauge 23 preferably has high, low, and overflow alarm setpoints, as suggested by the arrows shown in the schematic drawing of FIG. 1. Tank 20 is also preferably provided with a vent 26 and an overflow outlet 27. Overflow outlet 27 is directed into an overflow drain 28 which is connected to a drain outflow line 31. Drain outflow line 31 is also connected to a drain control valve 30 which controls emptying of mix tank 20. A mix tank drain line 29 is connected between the mix tank and valve 30.

Mix tank 20 also has a mix tank outflow line 32 which conveys diluted additive to a diluted additive distribution manifold 33.

The concentrate and mix tank subsystem described above is preferably operated by first draining the contents of mix tank 20 by opening valve 30 and allowing any residual contents to discharge through the drain outflow line 31. Valve 30 is closed and the emptied mix tank is then charged with a suitable amount of the concentrated liquid additive 11 from reservoir 10. The concentrate is supplied by pumping concentrate 11 via suction line 13 through pump 12 with controlled delivery via concentrate delivery control valve 17 and mix tank concentrate feed line 19. Pump 12 is most preferably controlled so as to delivery a precise amount of surfactant or other desired concentrate to the mix tank.

The delivery of concentrate is regulated with greater precision by utilizing control valve 17 and recycle valve 18 in combination with recycle line 21. Pump 12 begins operation to charge the gang of valves 15, 17, and 18 with recycle occurring back through recycle line 21 to the interior of reservoir 10. Once this fluid loop is fully filled with concentrate, then valve 17 is opened and the rate of delivery is calculated either using an integrating flowmeter, or more preferably counting of the metering pump strokes.

Once the mix tank is charged with concentrate, then it is ready to receive diluent via line 24 as controlled by diluent feed control valve 25. In the preferred embodiment, the diluent is deionized water which is discharged into the mix tank from line 24. The discharging diluent causes mixing with the previously supplied concentrate to produce a substantially homogeneous diluted additive within mix tank 20. Diluent is supplied via line 24 until a desired level is achieved; for example, when the level sensor 23 detects a preset "high" level. At that point, valve 25 is closed and the relative proportions of diluent and concentrate are fixed.

The resulting diluted additive contained within mix tank 20 is delivered through line 32 to the diluted additive distribution manifold 33. Manifold 33 has a plurality of diluent additive branch lines 35. Diluent additive branch lines 35 preferably have suitable means for measuring and adjusting the flow of diluted additive. This monitoring and adjustment is particularly important in the case where there are numerous lines so that balanced flows can be achieved. As shown, lines 35 are each provided with injection adjustment valves 37. Injection adjustment valves 37 are preferably manually controlled valves which allow the flow rate in each of the branch lines to be adjusted to approximately equal flow rates. The flow rates through lines 35 are monitored by suitable flowmeters 38, which are preferably flowmeters having low flow rate alarms, as indicated by the arrows in FIG. 1. The manual adjustment valves 37 and flowmeters can advantageously be integrated into a single combined unit such as those available from Futurestar of Edina, Minn. under the model names Pathfinder or Odyssey. Other flowmeters or branch line flow control valves are also possible.

Branch lines 35 also have injection control valves 39 which are electrically controlled, pneumatically operated valves as indicated above. The outflow from valves 39 are fed to aspirator-injectors 40.

Figure 2:
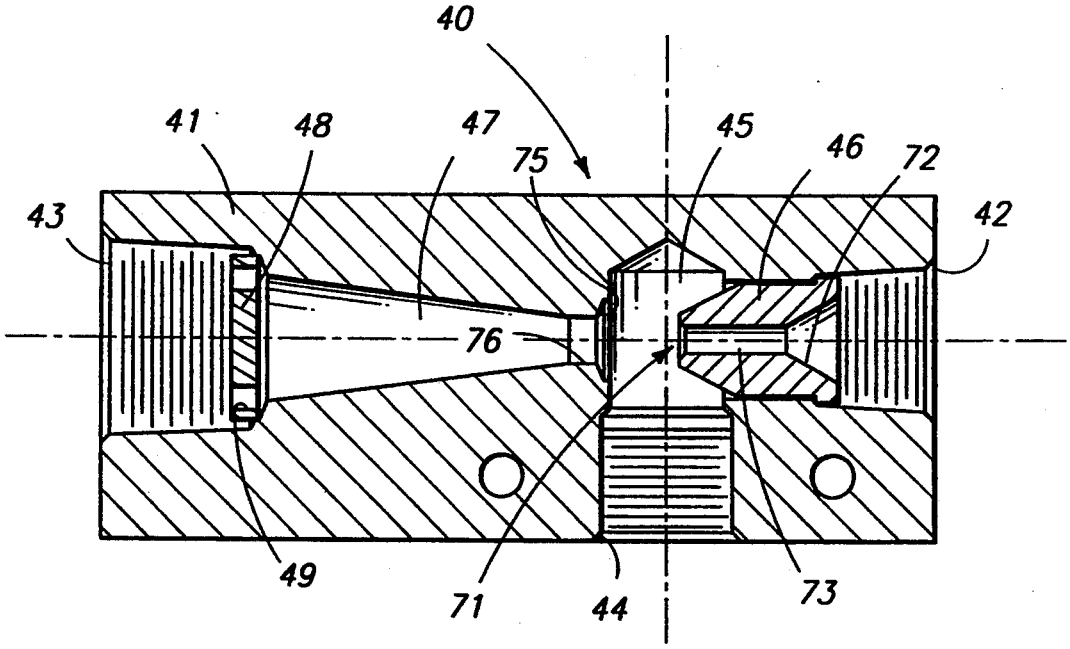
FIG. 2 is an enlarged sectional view showing a preferred construction of aspirator-injector forming a part of the system of FIG. 1.

FIG. 2 shows a preferred embodiment of aspirator-injector 40 used in accordance with this invention. Injectors 40 are advantageously formed from a body piece 41 made of a suitable material, such as polytetrafluoroethylene or other suitable material. The inlet end of body piece 41 is preferably provided a first or inlet port 42 which can advantageously be threaded to allow coupling with related liquid flow tubing or piping. Body piece 41 is also provided with a second or outflow port 43 at the opposite or outlet end. Body piece 41 is still further provided with a third or suction port 44 through which is fed the diluted additive conveyed in branch lines 35.

Injector 40 has a through passageway from the inflow or infeed port 42 to the outfeed or outflow port 43. Adjacent to the infeed port 42 there is mounted a flow restriction and jet forming device or venturi piece 46. Piece 46 has internal passageway 71 which preferably has a tapered section 72 towards the inlet end and a orifice or constricted portion 73.

Primary fluid is fed through inlet 42 and is accelerated by the constriction provided by venturi piece 46. The accelerated flow emits from constriction section 73 and jets across remaining portions of injection chamber 45. Injection chamber 45 is in fluid communication with suction port 44. The jet creates a reduced pressure which generates the suction through port 44. Diluted additive from the associated branch line 37 enters port 44 and fills chamber 45. It is entrained with the primary liquid jet, but in a greatly diluted ratio thereto.

The jet and entrained additive are received within mixing section entrance port 75. Port 75 joins with a mixing section neck portion 76. Neck portion 76 smoothly meets with diverging or expanding mixing section chamber 47. A diffuser piece 48 is preferably fitted at the end of the mixing section. Diffuser 48 includes suitable diffuser apertures 49 through which mixed primary and additive liquids pass. As shown, apertures 49 are advantageously six in number and arranged in an equiangularly spaced arrangement about the longitudinal axis of injector 40.

The outflow from injector 40 is advantageously supplied to a processing chamber 88 via processing chamber spray heads or nozzles 89. Spray nozzles 89 direct fluid towards semiconductor wafer holders, carriers, or other semiconductor pieces or handling equipment. Examples of suitable processors include the centrifugal wafer carrier cleaning apparatus described in U.S. Pat. No. 5,224,503, which is hereby incorporated hereinto by reference. The semiconductor processor liquid blending system of FIG. 1 is advantageously incorporated into a centrifugal wafer carrier cleaning apparatus the same or similar to that shown in U.S. Pat. No. 5,224,503, or other suitable semiconductor processor. As shown the spray heads 89 are provided in two distinct banks, such as for inwardly directed nozzles and outwardly directed nozzles. Other configurations are also possible.

Primary liquid is provided to spray nozzles 89 from suitable sources of primary liquid 54. Sources 54 are in the preferred embodiment supplies for deionized water. The supplies of deionized water are in fluid communication with pressure reduction regulators 56. Pressure gauges 55 are advantageously included downstream from regulators 56 to indicate the pressure which is being delivered from the pressure regulators 56.

The deionized water or other suitable primary liquid is conveyed through primary liquid supply lines 57. The primary liquid supply lines 57 are advantageously provided with primary liquid flow adjustment valves 58, which are advantageously manual throttling valves. Primary liquid flowmeters 59 are also preferably included in lines 57 to indicate the flow rate of primary liquid being delivered to nozzles 89. Primary liquid supply lines 57 are advantageously connected to primary liquid distribution manifold 60. Primary liquid branch lines 61 branch from manifold 60 and are plumbed to primary liquid control valves 51. Recycle bleed lines 81 tee off from branch lines 61 just upstream from valves 51 to aid in providing a continuous flow of liquid, even when control valves 51 are closed. This recycle subsystem will be explained in greater detail below.

Valves 51 are preferably electrically controlled, pneumatically operated valves which turn the flow of primary liquid on or off as needed for operation of spray nozzles 89. Manual cut-off valves 50 can also advantageously be provided between control valves 51 and aspirator-injectors 40 for maintenance or other purposes. Cut-off valves 50 are normally open.

Primary liquid control valves 51 are preferably ganged with primary liquid purge valves 52. Compressed gas, such as nitrogen or clean dry air is supplied through purge gas branch lines 66 to valves 52. When valves 51 are operated into a closed position, purge valves 52 open to allow flow of compressed gas through remaining parts of valves 51 to blow out the downstream portions 68 of primary liquid supply lines 57. This clears the downstream portions 68, and the associated aspirator-injectors 40 and nozzles 89 of any remaining mixed primary liquid and additive.

The semiconductor processing industry has high susceptibility to damage from contamination. This leads to an exceedingly high level of cleanliness and purity being needed in order to reduce or prevent contamination. The system of FIG. 1 is preferably provided with a primary liquid recycle system 80 to reduce the risk of bacterial growth in primary liquid supply lines 57 which are upstream from valves 51. The recycle system includes branch or bleed lines 81 which tee from the primary liquid supply branch lines 61 near valves 51. The bleed lines 81 are piped to a suitable collector, such as the recycle bleed line receiving manifolds 82. There is also a recycle bleed line 81 running from immediately upstream of valve 25 to one of manifolds 82. Dual manifolds are preferably used because the primary liquid supply system is also provided with two different subsystems. This reduces the possibility of fluid flows being unbalanced due to connection between the two separate flow subsystems. The outflow from manifolds 82 are preferably provided with recycle balance valves 83. The outputs from valves 83 are joined together at recycle return line 84. Recycle return line 84 is directed to a suitable drain or reprocessing subsystem as desired.

This invention also includes novel methods for blending concentrated liquid additive into an actively flowing primary liquid. Methods are particularly useful in blending concentrated liquid additives into a plurality of primary liquid supply lines containing active flows of primary liquid for delivery to spray heads of a semiconductor processor. The methods include delivering a controlled amount of concentrated liquid additive from a concentrate reservoir to a mix tank. This is advantageously accomplished by sucking concentrated liquid additive from reservoir 10 through line 13 to pump 12. Pump 12 is preferably then used for pumping the concentrated liquid additive. The concentrated liquid additive is supplied by suitably controlling the concentrate delivery valve 17 and concentrate recycle valve 18. This can be done to provide delivery of the concentrated liquid additive to the mix tank 20 or by recycling the concentrate to reservoir 10. The concentrate is preferably initially recycled to charge the pump and recycle loop prior to delivering the concentrate to mix tank 20.

Methods also preferably include draining or emptying the mix tank prior to delivering concentrated liquid additive thereto. This allows the mix tank to be used from a more closely controlled reference point and thus provides a referencing function relative to the mix tank contents. This referencing function most preferably removes all prior diluted liquid additive from the mix tank before another batch is prepared.

Novel methods of this invention further include diluting the concentrated liquid additive charged within the mix tank. This diluting step can most preferably be accomplished by supplying diluent to the mix tank. The diluent is preferably controllably supplied to provide a resulting predetermined mix ratio. The diluent is preferably supplied to the mix tank by jetting it into the mix tank containing concentrated additive, thereby mixing and homogenizing the diluted liquid additive produced in this first dilution process sequence.

The novel methods still further include flowing or supplying primary liquid through aspirator-injectors mounted in the primary liquid supply lines. This flowing produces actively flowing primary liquid streams into which the diluted additive from mix tank 20 is injected. The methods additionally include injecting diluted additive into the flowing primary liquid flows via said aspirator-injectors. This accordingly provides a plurality of active flows of primary liquid to provide two-stage diluted liquid additive therein.

The invention can be made using system components which are commercially available using typical fabrication processes. The materials of construction vary for the intended service. As shown, most components are either polytetrafluoroethylene or stainless steel. Other suitable materials are also possible consistent with the liquids being handled.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

We claim:

1. A semiconductor processor liquid blending system for blending a concentrated liquid additive into an actively flowing primary liquid, comprising:

a concentrate reservoir for holding concentrated liquid additive;

a first dilution mix tank;

a pump for delivering concentrated liquid additive from the concentrate reservoir to the mix tank;

a diluent supply for supplying diluent to the mix tank to produce a diluted additive therein;

at least one primary liquid supply line through which primary liquid is supplied;

at least one aspirator-injector connected to receive liquid flowing through said at least one liquid supply line; said aspirator-injector having inflow and outflow ports and a suction port connected to receive diluted additive from said mix tank;

whereby diluted additive is injected into said primary liquid at said aspirator-injector to provide two-stage dilution of the additive.

2. A semiconductor processor liquid blending system according to claim 1 and further comprising a mix tank gauge for measuring the contents of the mix tank.

3. A semiconductor processor liquid blending system according to claim 1 and further comprising at least one injection flowmeter for sensing the flow rate of diluted additive to said at least one aspirator-injector.

4. A semiconductor processor liquid blending system according to claim 1 and further comprising at least one injection flowmeter for indicating the flow rate of diluted additive to said at least one aspirator-injector; said injection flowmeter having a low flow rate alarm.

5. A semiconductor processor liquid blending system according to claim 1 and further comprising at least one injection adjustment valve connected to provide adjustment of the flow rate of the diluted additive to said at least one aspirator-injector.

6. A semiconductor processor liquid blending system according to claim 1 wherein said pump is a metering pump capable of delivering metered amounts of the concentrated liquid additive.

7. A semiconductor processor liquid blending system according to claim 1 wherein said at least one aspirator-injector has a diffuser for aiding in mixing of the additive within the aspirator-injector.

8. A semiconductor processor liquid blending system according to claim 1 and further comprising at least one primary liquid control valve for controlling the flow of primary liquid through said at least one aspirator-injector.

9. A semiconductor processor liquid blending system according to claim 1 and further comprising:

at least one injection flowmeter for indicating the flow rate of diluted additive to said at least one aspirator-injector;

at least one injection adjustment valve connected to provide adjustment of the flow rate of the diluted additive to said at least one aspirator-injector.

10. A semiconductor processor liquid blending system according to claim 1 and further comprising at least one spray nozzle connected to said primary liquid supply line downstream of said at least one aspirator-injector to receive primary liquid mixed with said liquid additive.

11. A semiconductor processor liquid blending system according to claim 1 and further comprising:

at least one primary liquid control valve for controlling the flow of primary liquid through said at least one aspirator-injector;

at least one primary gas purge for providing purge gas through the primary liquid supply line and said at least one aspirator-injector to drive primary liquid therefrom.

12. A semiconductor processor liquid blending system according to claim 1 and further comprising:

at least one primary liquid control valve for controlling the flow of primary liquid through said at least one aspirator-injector;

at least one primary gas purge for providing purge gas through the primary liquid supply line and said at least one aspirator-injector to drive primary liquid therefrom;

at least one primary liquid recycle line connected adjacent to said at least one primary liquid control valves for providing a continuous migration of water through the primary liquid supply line upstream of said primary liquid control valve when the primary liquid control valve is closed.

13. A semiconductor processor liquid blending system for blending a concentrated liquid additive into an actively flowing primary liquid, comprising:

a concentrate reservoir for holding concentrated liquid additive;

a first dilution mix tank;

a pump for delivering concentrated liquid additive from the concentrate reservoir to the mix tank;

a diluent supply for supplying diluent to the mix tank to produce a diluted additive therein;

a plurality of primary liquid supply lines through which primary liquid is supplied;

a plurality of aspirator-injectors connected in said liquid supply lines; said aspirator-injectors having inflow and outflow ports and a suction port connected to receive diluted additive from said mix tank;

whereby diluted additive is injected into the primary liquid at said aspirator-injectors to provide two-stage dilution of the additive.

14. A semiconductor processor liquid blending system according to claim 13 and further comprising a mix tank gauge for measuring the contents of the mix tank.

15. A semiconductor processor liquid blending system according to claim 13 and further comprising a plurality of injection flowmeters for indicating the flow rates of diluted additive to said plurality of aspirator-injectors.

16. A semiconductor processor liquid blending system according to claim 13 and further comprising a plurality of injection flowmeters for indicating the flow rates of diluted additive to said plurality of aspirator-injectors; said injection flowmeters having a low flow rate alarms.

17. A semiconductor processor liquid blending system according to claim 13 and further comprising a plurality of injection adjustment valves connected to provide adjustment of the flow rate of the diluted additive to said plurality of aspirator-injectors.

18. A semiconductor processor liquid blending system according to claim 13 wherein said pump is a metering pump capable of delivering metered amounts of the concentrated liquid additive.

19. A semiconductor processor liquid blending system according to claim 13 wherein said plurality of aspirator-injectors have a diffuser for aiding in mixing of the additive within the aspirator-injectors.

20. A semiconductor processor liquid blending system according to claim 13 and further comprising a plurality of primary liquid control valves for controlling the flow of primary liquid through said plurality of aspirator-injectors.

21. A semiconductor processor liquid blending system according to claim 13 and further comprising:

a plurality of injection flowmeters for indicating the flow rate of diluted additive to said plurality of aspirator-injectors;

a plurality of injection adjustment valves connected to provide adjustment of the flow rate of the diluted additive to said plurality of aspirator-injectors.

22. A semiconductor processor liquid blending system according to claim 13 and further comprising a plurality of spray nozzles connected to said primary liquid supply lines downstream of said plurality of aspirator-injectors to receive primary liquid mixed with said liquid additive.

23. A semiconductor processor liquid blending system according to claim 13 and further comprising:

a plurality of primary liquid control valves for controlling the flow of primary liquid through said plurality of aspirator-injectors;

a plurality of primary gas purges for providing purge gas through the primary liquid supply lines and said plurality of aspirator-injectors to drive primary liquid therefrom.

24. A semiconductor processor liquid blending system according to claim 13 and further comprising:

a plurality of primary liquid control valves for controlling the flow of primary liquid through said plurality of aspirator-injectors;

a plurality of primary gas purges for providing purge gas through the primary liquid supply lines and said plurality of aspirator-injectors to drive primary liquid therefrom;

a plurality of primary liquid recycle lines connected adjacent to said plurality of primary liquid control valves for providing a continuous migration of water through the primary liquid supply lines upstream of said primary liquid control valves when the primary liquid control valves are closed.

25. A method for blending a concentrated liquid additive into a plurality of primary liquid supply lines containing active flows of primary liquid for delivery by spray heads into a semiconductor processor chamber, comprising:

delivering a controlled amount of concentrated liquid additive from a concentrate reservoir to a mix tank;

diluting the concentrated liquid additive held within the mix tank by supplying a controlled amount of diluent to the mix tank to produce diluted additive;

flowing primary liquid through aspirator-injectors mounted in the primary liquid supply lines;

injecting diluted additive into flowing primary liquid via said aspirator-injectors;

to thereby provide a plurality of active flows of primary liquid containing two-stage diluted liquid additive.

26. A method according to claim 25 and further defined by emptying the mix tank prior to said delivering step.

27. A method according to claim 25 and further defined by balancing flows of diluted additive to the aspirator-injectors.

28. A method for blending a concentrated liquid additive into an active flow of primary liquid within a semiconductor processor, comprising:

delivering a controlled amount of concentrated liquid additive from a concentrate reservoir to a mix tank;

diluting the concentrated liquid additive held within the mix tank by supplying a controlled amount of diluent to the mix tank to produce diluted additive;

flowing primary liquid through an aspirator-injector mounted in a primary liquid supply line;

injecting diluted additive into flowing primary liquid via said aspirator-injector;

spraying the primary liquid with additive from a spray nozzle.

29. A method according to claim 28 and further defined by emptying the mix tank prior to said delivering step.

30. A method for blending a concentrated liquid additive into an active flow of primary liquid, comprising:

delivering a controlled amount of concentrated liquid additive from a concentrate reservoir to a mix tank;

diluting the concentrated liquid additive held within the mix tank by supplying a controlled amount of diluent to the mix tank to produce diluted additive;

flowing primary liquid through an aspirator-injector mounted in a primary liquid supply line;

injecting diluted additive into flowing primary liquid via said aspirator-injector;

to thereby provide an active flow of primary liquid containing two-stage diluted liquid additive.

31. A method according to claim 30 and further defined by emptying the mix tank prior to said delivering step.

* * * * *